United States Patent [19]

Schlicht

[11] Patent Number: 4,965,003

[45] **Date of Patent: * Oct. 23, 1990**

[54] BORATED DETERGENT ADDITIVE BY AN IMPROVED PROCESS

[75] Inventor: Raymond C. Schlicht, Fishkill, N.Y.

[73] Assignee: Texaco Inc., White Plains, N.Y.

[ * ] Notice: The portion of the term of this patent subsequent to Oct. 23, 2007 has been disclaimed.

[21] Appl. No.: 342,137

[22] Filed: Apr. 21, 1989

[51] Int. Cl.[5] ..... C10M 105/72

[52] U.S. Cl. ..... 252/38; 252/39; 252/41; 252/32; 252/33.4

[58] Field of Search ..... 252/38, 39, 41, 33, 252/33.4

[56] References Cited

U.S. PATENT DOCUMENTS

| | | | |
|---|---|---|---|
| 3,480,548 | 11/1969 | Hellmuth | 252/33.4 |
| 3,679,584 | 7/1972 | Hellmuth | 252/33.4 |
| 3,829,381 | 8/1974 | Le Suer | 252/33.4 |
| 3,907,691 | 9/1975 | King | 252/33 X |
| 3,929,650 | 12/1975 | King | 252/33 X |
| 4,539,126 | 9/1985 | Bleeker | 252/39 |
| 4,566,489 | 12/1985 | Muir | 252/18 X |
| 4,683,126 | 7/1987 | Inoue | 252/18 X |

*Primary Examiner*—Olik Chaudhuri
*Assistant Examiner*—James M. Hunter, Jr.
*Attorney, Agent, or Firm*—Robert A. Kulason; James J. O'Loughlin; Vincent A. Mallare

[57] ABSTRACT

A process for preparing a borated, overbased metal detergent additive for lubricants which comprises dissolving a metal salt in a hydrocarbon solvent, adding a metal base and a polar solvent, treating with an acid gas, filtering the mixture to form a filtrate to which boric acid is added, heating the boric acid/filtrate mixture, stripping the cooled boric acid/filtrate reaction mixture and recovering the borated metal detergent additive therefrom.

42 Claims, No Drawings

BORATED DETERGENT ADDITIVE BY AN IMPROVED PROCESS

BACKGROUND OF THE INVENTION

1. Field of the Invention

This invention relates to lubricating oils containing borated detergent additives which inhibit rust, corrosion and deposits of fuels and lubricating oils resulting from the accumulation in engines of the oxidation and degradation products. More specifically, this invention discloses an improved process for preparing borated detergent additives for use in lubricants.

When mineral lubricating oils are employed as crankcase lubricants in internal combustion engines, fuel and lubricant oxidation and degradation products accumulate in the lubricant and impinge on the engine surfaces with the resultant formation of gums, sludges which clog the oil feed lines and varnish-like deposits on the surfaces of rings, pistons, cylinders and other engine parts. Further, with emission control devices being installed on the presently manufactured automotive vehicles, some of the corrosive bodies of the engine exhaust system are introduced into the crankcase oil. The gums and sludges lead to piston sticking and varnish on the cylinder walls. This, coupled with the attack of the corrosive bodies on the engine metal surfaces, cause substantial deterioration of the engine operation.

In order to counteract these negative factors, additives are added to crankcase oils in small amounts such as dispersants and detergents to counteract the formation of gums and sludges and anticorrosives to inhibit the corrosive action of the exhaust gases introduced into the crankcase system, as well as rust inhibitors to prevent rust formation on engine metal parts.

2. Disclosure Statement

U.S. Pat. No. 3,480,548 discloses a process for preparing a borated, overbased metal detergent which process utilizes an overbased metal detergent in reaction with boric acid at a very high temperature of 150°-175° C.

U.S. Pat. No. 3,679,584 discloses a process which utilizes that of U.S. Pat. No. 3,480,548 to prepare a borated intermediate which is subsequently overbased further.

U.S Pat. No. 3,829,381 discloses a process similar to that of U.S. Pat. No. 3,480,548 whereby an overbased metal detergent is produced.

U.S. Pat. No. 3,909,691 discloses a borated overbased alkaline earth metal sulfonate prepared by a process similar to that of U.S. Pat. No. 3,480,548 where the overbased earth metal sulfonate is then treated with an alkali metal base.

U.S. Pat. No. 4,683,126 discloses the preparation of an alkaline earth metal borate dispersion in a sulfonate by in situ reaction of a metal oxide or hydroxide with boric acid in the presence of water and a hydrocarbon solvent.

U.S. Ser. No. 833,689 discloses a lubricating oil composition which has improved properties of inhibiting rust, corrosive and deposit formation. The improved properties are imparted by the addition of minor amounts of a metal salt of an alkenylsuccinamic acid.

SUMMARY OF THE INVENTION

The present invention is related to the formulation of lubricating oil compositions which have improved oxidation resistance as well as rust, corrosion and deposit formation inhibiting properties. The present lubricating oil compositions comprise a major portion of a base oil of lubricating viscosity and a minor effective rust/corrosion inhibiting amount of a borated detergent additive prepared by a process comprising:

(a) mixing a metal salt dissolved in a hydrocarbon solvent with a metal base and a polar solvent;

(b) treating the metal salt mixture at a temperature ranging from about 10° to about 100° C. by passing an acid gas through the mixture;

(c) filtering the treated mixture at a temperature of about 10° to about 100° C.;

(d) adding a borating agent to the filtrate and reacting the filtrate for a period of about 0.25 to about 5.0 hours at a temperature ranging from about 15° to about 100° C.

(e) heating the borated mixture at a temperature sufficiently high to distill a major portion of the polar solvent and water therefrom;

(f) cooling the distilled borated mixture to below the boiling point of the remaining solvent and filtering the cooled filtrate mixture; and (g) stripping the cooled distilled filtrate mixture under a pressure ranging from about 10 to about 200 mm Hg at a temperature ranging from about 20° to about 150° C., thereby recovering the borated metal detergent additive.

DETAILED DESCRIPTION OF THE INVENTION

The lubricating oil composition of the present invention has improved operation resistance as well as rust and corrosion inhibiting properties and deposits reducing properties in either an automotive or a diesel engine or their respective oil crankcases.

The present lubricating oil compositions are comprised of a major portion of a base oil of lubricating viscosity and a minor effective rust/corrosion deposits inhibiting amount of a borated detergent additive which is prepared by the process comprising:

(a) mixing a metal salt dissolved in a hydrocarbon solvent with a metal base and a polar solvent;

(b) treating the metal salt mixture at a temperature ranging from about 10° to about 100° C. by passing an acid gas through the mixture;

(c) filtering the mixture at a temperature of about 10° to about 100° C.;

(d) adding a borating agent to the filtrate and reacting for a period of about 0.25 to about 5.0 hours at a temperature ranging from about 15° to about 100° C.;

(e) heating the borated mixture at a temperature sufficiently high to distill a major portion of the polar solvent and water therefrom;

(f) cooling the distilled borated mixture to below the boiling point of the remaining solvent and filtering the cooled filtrate mixture; and (g) stripping the cooled distilled filtrate mixture under a pressure ranging from about 10 to about 200 mm Hg at a temperature ranging from about 20° to about 150° C., thereby recovering the borated metal detergent additive.

The metal salt which is dissolved in a hydrocarbon solvent may be a metal salt selected from the group of salts of the metals of lithium, sodium, potassium, calcium, barium and magnesium, mineral oil sulfonates, ($C_{12}$–$C_{50}$) alkyl sulfonates, ($C_{12}$–$C_{50}$) aryl sulfonates, ($C_{12}$–$C_{50}$) alkenyl sulfonates, ($C_{12}$–$C_{50}$) alkylphenol sulfonates, ($C_{12}$–$C_{50}$) alkyl salicylates, ($C_{12}$–$C_{50}$) alkylphenates, sulfur-coupled ($C_{12}$–$C_{50}$) alkylphenates, amino bis-($C_1$–$C_{10}$) alkylene-coupled ($C_{12}$–$C_{50}$) alkylphenates, ($C_1$–$C_{10}$) alkylene-coupled ($C_{12}$–$C_{50}$) alkylphenates,($C_{12}$–$C_{50}$) alkanecarboxylates, ($C_{12}$–$C_{50}$)-alkenylsuccinamates, ($C_{12}$–$C_{50}$) alkane or olefin oxidates and ($C_{12}$–$C_{50}$)-alkylaryl carboxylates.

The preferred metal detergent salts which are overbased according to the present invention are provided below in Table I.

TABLE I

Preferred Metal Detergent Salts

1. Calcium, magnesium or sodium salts of a sulfonated mineral oil feedstock, where the fraction of the oil feedstock which is sulfonated, provides a metal sulfonate which has an average equivalent weight ranging from 350 to 800, preferably 400 to 500. The above are normally employed as 20–80 percent active ingredient in a mineral oil diluent.
2. Calcium, magnesium or sodium salts of a sulfonated alkylated aromatic feedstock where the aromatic compound may be benzene, toluene, xylene or napthalene and which is alkylated with one or more ($C_{12}$–$C_{30}$)-alkyl groups derived from straight or branched chain olefins or alkyl halides. The preferred feedstocks are ($C_{12}$–$C_{18}$)-linear olefin-alkylated benzene, ($C_{12}$–$C_{18}$)-polypropylene-alkylated benzene or ($C_{12}$–$C_{24}$)-polybutylene-alkylated benzene (these may be mono- or di-alkylated or mixed mono- and dialkylated benzene). The preferred metal sulfonate has an average equivalent weight of 350–800 and may be employed in the form of a 20–80 percent active ingredient in a mineral oil diluent.
3. Calcium, magnesium or sodium sulfonates which are comprised of mixtures of mineral oil sulfonates and alkylated aromatic sulfonates ranging from 20–90 percent mineral oil sulfonate component, preferably 40–60 percent. These sulfonates may also be employed in the form of 20–80 percent active ingredient in a mineral oil diluent.
4. Calcium, magnesium or sodium sulfurized alkylphenates where the alkyl groups may be ($C_{12}$–$C_{30}$), either linear or branched. These alkylphenates may be employed in the form of 20–80 percent active ingredient in a mineral oil diluent.
5. Calcium, magnesium or sodium alkenyl succinamates prepared by neutralization of a reaction product of a ($C_{24}$–$C_{50}$) alkenylsuccinic acid anhydride (ASAA) with a primary or secondary amine. The preferred alkenylsuccinamates may be prepared from 400–800 average molecular weight ASAA and a secondary amine such as morpholine, diethanolamine, dimethylamine or N-methylaniline.

The hydrocarbon solvent which may be used in the present process may be selected from the group consisting of n-pentane, n-hexane, cyclohexane, n-heptane, n-octane, isoctane, n-decane, benzene, toluene, xylene and mixtures thereof. Preferably, the hydrocarbon solvent is a ($C_6$–$C_8$) aliphatic hydrocarbon.

The polar solvent used in this process may be selected from the group consisting of ($C_1$–$C_5$) alcohols, glycols, glycol monoethers, water and mixtures thereof.

The metal base which may be used in the present process may be the selected from the group consisting of LiOH, $Ca(OH)_2$, $Ba(OH)_2$, NaOH, KOH, $Mg(OH)_2$, $Li_2O$, CaO, $Na_2O$, $K_2O$, MgO, alkoxides of ($C_1$–$C_5$) alcohols, glycols and glycol-mono-ethers.

According to the present process, the metal salt contains a diluent oil consisting essentially of a mineral oil or synthetic oil having a kinematic viscosity of about 15 to about 40 cs at 40° C.

While the mixture of the metal base and metal salt solution is being heated, the acid gas is passed through the mixture of about 1.0 to about 30.0 moles of metal base per mole of the metal salt. The acid gas is preferably $CO_2$ or $SO_2$, which gas is passed through the mixture at a quantity of about 0.5 to about 2.0 mole per mole of metal base at a temperature ranging from about 10° to about 100° C. for a period of about 0.5 to about 5.0 hours. The reaction mixture is then filtered at 10° to 100° C., having been cooled as needed to the desired filtration temperature. Additional hydrocarbon solvent may be employed, if desired, to complete the transfer of the reaction mixture from the reaction vessel through the filtration equipment.

The borating agent used in the present process may be boric acid or boric oxide. The borating agent is added to the filtrate at a temperature ranging from about 20° to about 60° C. Then the borated mixture is heated to a maximum temperature equal to the reflux temperature of the solvent mixture for a period of about 0.0 to about 4.0 hours before a major portion of the polar solvent and water are distilled therefrom. After the solvent and water are distilled, the distilled borated mixture is cooled to a temperature ranging from about 80° to about 20° C. After being cooled, the cooled distilled borated mixture is stripped under atmospheric or sub-atmospheric pressure at a temperature ranging from bout 80° to about 180° C.

In the present process, the ratio of hydrocarbon solvent to the polar solvent ranges from about 0.1 to about 10.0 parts of hydrocarbon solvent per part of polar solvent. And the ratio of polar solvent to metal salt ranges from about 0.05 to about 1.0 part per part of metal salt.

According to the present invention, the metal salt is overbased with about 1.0 to about 30 moles of metal base per mole of metal salt; and, the metal salt is borated with about 0.10 to about 5.0 moles of borating agent per mole of metal base.

According to the present invention, in the process of preparing the lubricant additive there is a second embodiment which comprises:

(a) mixing a metal salt dissolved in a hydrocarbon solvent with a metal base and a polar solvent;

(b) treating the metal salt mixture at a temperature ranging from about 10° to 100° C. by passing an acid gas through the mixture;

(c) adding a borating agent to the treated reaction mixture and reacting the mixture for a period of about 0.25 to about 5.0 hours at a temperature ranging from about 15° to about 100° C.

(d) heating the borated mixture at a temperature sufficiently high to distill the polar solvent and water therefrom;

(e) cooling the distilled borated mixture to below the boiling point of the remaining solvent and filtering the cooled filtrate mixture; and (f) stripping the cooled distilled filtrate mixture under a pressure ranging from about 10 to about 200 mm Hg at a temperature ranging from about 20° to about 150° C. thereby recovering the borated metal detergent additive.

In this second embodiment, the optional procedure of not filtering the acid gas-treated reaction mixture prior to boration is followed. Otherwise, the same components such as the hydrocarbon and polar solvents, the metal salt, the metal base and conditions are the same for this second embodiment.

Another feature of these overbased products is that they are prepared by blowing $CO_2$, $SO_2$ or other acid gases through the reaction mixture in the absence of other acids, ammonia, phenols or other well known promoters.

The present invention is an improved process for the preparation of borated, overbased metal detergents which incorporates a low temperature boration step at an intermediate stage in the conventional overbasing process, prior to removal of the reaction solvents and water of reaction from the overbasing step. This process differs from the closest prior art (U.S. Pat. No. 3,480,548) which employs a finished (filtered and solvent-free), overbased metal detergent (a $CaCo_3$-overbased calcium sulfonate) in reaction with boric acid or other borating agent at a very high temperature (150°-175° C.). This results in the vigorous evolution of both $CO_2$ and water which causes severe foaming problems and therefore necessitates the slow, gradual addition of the boric acid.

The present invention is improved over the closest prior art (U.S. Pat. No. 3,480,548) in that (a) the boric is added over less than 0.5 hr (vs. 1.5 hr for U.S. Pat. No. 3,480,548) and reacts at lower temperatures (<100° C.) in the presence of the overbasing solvents; this results in greater processing ease since there is only minimal foaming (only $CO_2$ is evolved as a gas at this stage), (b) the boric acid is dissolved by the polar solvents resulting in an efficient uptake of boron into the product, (c) filtration carried out at lower more convenient temperatures in a hydrocarbon solvent and (d) overall shorter reaction times result in improved economics (the isolation of the overbased detergent intermediate is eliminated and shorter boric acid addition time is required).

Two process variants, i.e., the first and second embodiments, are based on the present invention, are shown below in Table II in schematic form with comparisons made to the U.S. Pat. No. 3,480,548 process. In the first step shown, the methods used are similar. The details for the subject processes are given in the illustrative examples which follow. Below, in Table II, the procedures of the first and second embodiments are compared with that of U.S. Pat. No. 3,480,548.

TABLE II

| Step | First Embodiment Process | Second Embodiment Process | U.S. 3,480,548 |
|---|---|---|---|
| 1 | Prepare overbased detergent reaction mixture | Same procedure | Similar Procedure |
| 2 | Filter at 60° C. | React with boric acid at 100° C. | Filter [1]* |
| 3 | React with boric acid at 100° C. | Distill out polar solvent, heating to about 100° C. | Strip out all solvents to an elevated temp.* |
| 4 | Distill out polar solvents, heating to about 100° C. | Filter at 60° C. | React with boric acid at 150°-175° C. |
| 5 | Filter at 60° C. | Strip out remaining solvent at 100°-120° C. | Filter at 150° C. |
| 6 | Strip out remaining solvent at 100°-120° C. | — | — |

*These steps (2 and 3) may be conducted in reverse order

The present processes may be applied to the boration of various types of overbased detergents such as metal sulfonates, salicylates, alkenylsuccinamates, phenolates, phenolates coupled with oxygen, sulfur, amino, alkylene, thio-or oxy-bis-alkylene, imino-or other amino (di-, tri, etc.) bis-alkylene groups which are overbased with metal oxides, hydroxides, alkoxides, carbonates, sulfites or sulfides. The metals may be alkali, alkaline earth or other metals. The preferred detergents are alkaline earth metal sulfonates overbased with alkaline earth or alkali hydroxides and/or carbonates. The preferred metals are calcium, magnesium, lithium and sodium. The ratio of borating agent ratio with 0.5-3 being preferred and 0.2-2 being especially preferred. The products of the present processes are useful as detergent additives in lubricants and fuels where they may protect the engines and peripheral equipment from rust, corrosion and engine deposits as well as protect the fluids from oxidative degradation.

The following examples illustrate the processes for preparing the borated overbased detergents of the present invention and their advantages over the prior act processes.

EXAMPLE I

First Embodiment Process

Overbasing Step

A mixture of 167.40 g (0.10 mole based on 2.39% Ca present) of an essentially neutral calcium sulfonate (a blend of alkylbenzene and mineral oil sulfonates) and 65.50 g mineral oil diluent was dissolved in 200 ml crude heptanes and then 45 ml methanol and 69.91 g (0.935 mole) calcium hydroxide were added with stirring. This mixture was heated to 60C. and the 0.85 mole carbon dioxide gas was bubbled through the mixture at 158 ml/min for two hours at 60C. under total reflux conditions. The $CO_2$-flow was terminated and the mixture was filtered through diatomaceous earth with heptane washing of the filtercake. A total of 475. g of filtrate was obtained. A 50.04 g portion of this filtrate was stripped to remove solvents and water up to 120C. at 11 mm Hg pressure to obtain 29.10 g of a clear, solvent-free intermediate product. It was found to contain 11.38 percent calcium and had a TBN (Total Base No.)=285.

Boration Step

The remaining 425.8 g of filtrate was thereby calculated to contain 247.6 g of the above intermediate on a solvent-free basis; from the TBN it was calculated to contain approximately 0.625 mole of solubilized calcium base (largely $CaCO_3$).

Then 40.93 g (0.662 mole) boric acid was added to the remaining filtrate over 15 minutes at 25°-27° C. The mixture was stirred another 15 minutes at ambient temperatures (27C.) and then heated to reflux, removing the methanol and water via azeotropic distillation into a Dean-Stark trap with recycle of the upper heptane layer. After 1.25 hour reflux at 100C. maximum, the reaction mixture was now essentially free of methanol and water. The mixture was cooled to room temperature and filtered through diatomaceous earth. This filtrate was stripped to 120C. at 11 mm Hg pressure. The clear, solvent-free product (263.3 g) was found to have the analyses shown below in Table III.

TABLE III

| | Found |
|---|---|
| % Ca | 10.98 |
| % B | 2.10 |
| % $CO_2$ | 6.88 |
| TBN | 263 |

From these analyses, it was calculated that about 80 percent of the boric acid was incorporated with essentially no loss of calcium; the calculated percent Ca=11.1, based on replacement of part of the $CaCO_3$ by $Ca(BO_2)_2$.

EXAMPLE 2

Second Embodiment Process

Overbasing Step

The same materials were used as in step of Example 1. The procedure differed only in that the reaction mixture was not filtered at the end of the $CO_2$-blowing step.

Boration Step

The above crude reaction mixture was cooled to 36C. and 52.50 g (0.85 mole) boric acid was added with stirring. This amount is equal to the theoretical maximum moles of $CaCO_3$ which may be generated, hence in both Examples 1 and 2, the mole ratio of calcium base:boric acid is 1:1).

The procedure employed was identical with Example 1. The filtration was somewhat more difficult than in the case of Example 1. The yield was 198.0 g clear, stripped product. The analyses found were as shown below in Table IV.

TABLE IV

| | |
|---|---|
| % Ca | 10.64 |
| % B | 2.02 |
| % $CO_2$ | 7.21 |
| TBN | 264 |

The %B corresponds to about 75 percent incorporation of the boric acid charged.

EXAMPLE 3

Reduced Boric Acid Charge vs Example 2

The same materials and process were employed as in Example 2 except only 10.51 g (0.170 mole) boric acid was charged (=0.20:1 mole ratio of boric acid:theoretical maximum moles of $CaCO_3$). The analyses found were as shown in Table V below.

TABLE V

| | |
|---|---|
| % Ca | 11.7 |
| % B | 0.49 |
| % $CO_2$ | 9.6 |
| TBN | 305 |

The %B corresponds to about 86 percent incorporation of the boric acid charged.

In all of the preceding examples, the amount of foaming was minor compared to the difficulty encountered in the following example which employed the procedure of U.S. Pat. No. 3,480,548.

EXAMPLE 4

U.S. Pat. No. 3,480,548 Process vs Example 1 Process

A commercial $CaCO_3$-overbased calcium sulfonate having a %Ca=12.7 and TBN=311 was borated as follows:

A 1,695 g quantity of the calcium sulfonate bearing 4.7 moles of dispersed calcium base (as calculated from the TBN) was heated to 150C. under a $N_2$ stream and 209.15 g (5.0 moles) boric acid was added portion-wise at intervals over 1.75 hours to keep the foam level below 2 inches. The final mixture was stirred 15 minutes at 150C. and then heated to 175C. where the reaction was continued for 2 hours more, distilling off the water of reaction. Then 75 g of diatomaceous earth filter aid was added and the mixture was stirred while cooling to about 150C. where it was filtered through a funnel packed with additional filter aid. The yield was 1,279 g clear product. Another 447 g of product, otherwise lost to the filter cake, was recovered by heptane extraction of the filter cake and stripping off the solvent to 120 at 12 mm Hg pressure.

The analyses were as shown below in Table VI.

TABLE VI

| | |
|---|---|
| % Ca | 11.27 |
| % B | 1.86 |
| % $CO_2$ | 7.5 |
| TBN | 275 |

Comparison to the products of Example 1 and Example 2 shows that less boron was incorporated into this product.

I claim:

1. A process for preparing a borated, overbased oil-soluble metal detergent additive for lubricants, said process comprising:

(a) mixing a metal salt dissolved in a hydrocarbon solvent with a metal base and a polar solvent;

(b) treating said metal salt mixture at a temperature ranging from about 10° to about 100° C. while passing an acid gas through the mixture;

(c) filtering said treated mixture at a temperature of about 10° to about 100° C.;

(d) adding a borating agent to said filtrate and reacting said filtrate for a period of about 0.25 to about 5.0 hours at a temperature ranging from about 15° to about 100° C.;

(e) heating said borated mixture at a temperature sufficiently high to distill a major portion of the polar solvent and water therefrom;

(f) cooling the distilled borated mixture to below the boiling point of the remaining solvent and filtering said cooled filtrate mixture; and (g) stripping the cooled distilled filtrate mixture under a pressure ranging from about 10 to about 200 mm Hg. at a temperature ranging from about 20° to about 150° C., thereby recovering the borated metal detergent additive.

2. The process of claim 1 wherein the metal salt is selected from the group of salts of the metals of lithium, sodium, potassium, calcium, barium and magnesium.

3. The process according to claim 1 wherein the hydrocarbon solvent is selected from the group consisting of n-pentane, n-hexane, cyclohexane, n-heptane, n-octane, isoctane, n-decane, benzene, toluene, xylene and mixtures thereof.

4. The process of claim 1 wherein said polar solvent is selected from the group consisting of ($C_1$–$C_5$) alcohols, glycols, glycol monoethers, water and mixtures thereof.

5. The process of claim 1 wherein said metal base is selected from the group consisting of lithium hydroxide, $Ca(OH)_2$, $Ba(OH)_2$ NaOH, KOH, $Mg(OH)_2$, $Li_2O$, CaO, $Na_2O$, $K_2O$, MgO, alkoxides of ($C_1$–$C_5$) alcohols, glycols and glycol-mono-ethers.

6. The process of claim 1 wherein the metal salt contains a diluent oil consisting essentially of a mineral oil or synthetic oil having a kinematic viscosity of about 15 to about 40 cs at 40° C.

7. The process of claim 1 wherein the parts by weight ratio of hydrocarbon solvent to polar solvent ranges from about 0.1:1.0 to about 10.0:1.0.

8. The process of claim 1 wherein the parts by weight ratio of polar solvent to metal salt ranges from about 0.05:1.0 to about 1.0:1.0.

9. The process of claim 1 wherein the metal salt is overbased with about 1.0 to about 30.0 moles of metal base per mole of metal salt.

10. The process of claim 1 wherein the metal salt is borated with about 0.10 to about 5.0 moles of borating agent per mole of metal base.

11. The process of claim 1 wherein the acid gas is passed through said mixture in a quantity of about 0.5 to about 2.0 moles per mole of metal base mixed with the metal salt.

12. The process of claim 11 wherein the acid gas is $CO_2$ or $SO_2$.

13. The process of claim 1 wherein the borating agent is added to said filtrate at a temperature ranging from about 20° to about 60° C.

14. The process of claim 13 wherein the borating agent is boric acid or boric oxide.

15. The process of claim 1 wherein the borated filtrated mixture is heated to a maximum temperature equal to the reflux temperature of solvent mixture for a period of about 0 to about 4.0 hours before the polar solvent and water are distilled therefrom.

16. The process of claim 1 wherein the distilled borated mixture is cooled to a temperature ranging from about 80° C. to about 20° C.

17. The process of claim 1 wherein the cooled distilled borated mixture is stripped under atmospheric pressure at a temperature ranging from about 80° to about 180° C.

18. The process of claim 12 wherein the $CO_2$ or $SO_2$ is passed through said mixture at a quantity of about 0.5 to about 1.0 mole per mole of metal base at a temperature ranging from about 20° to about 100° C. for a period of about 0.5 to about 5.0 hours.

19. The process of claim 2 wherein said hydrocarbon solvent is a ($C_6$–$C_8$) aliphatic hydrocarbon.

20. The process of claim 2 wherein said polar solvent is methanol.

21. A process for preparing a borated, overbased oil-soluble metal detergent additive for lubricants, said process comprising:

(a) mixing a metal salt dissolved in a hydrocarbon solvent with a metal base and a polar solvent;

(b) treating said metal salt mixture at a temperature ranging from about 10° to about 100° C. by passing an acid gas through the mixture;

(c) adding a borating agent to said treated mixture and reacting said mixture for a period of about 0.25 to about 5.0 hours at a temperature ranging from about 15° to about 100° C.;

(d) heating said borated mixture at a temperature sufficiently high to distill a major portion of the polar solvent and water therefrom;

(e) cooling the distilled borated mixture to below the boiling point of the remaining solvent and filtering said cooled filtrate mixture; and (f) stripping the cooled distilled filtrate mixture under a pressure ranging from about 10 to about 200 mm Hg. at a temperature ranging from about 20° to about 150° C., thereby recovering the borated metal detergent additive.

22. The process of claim 21 wherein the metal salt is selected from the group of salts of the metals of lithium, sodium, potassium, calcium, barium, and magnesium.

23. The process according to claim 21 wherein the hydrocarbon solvent is selected from the group consisting of n-pentane, n-hexane, cyclohexane, n-heptane, n-octane, isoctane, n-decane, benzene, toluene, xylene and mixtures thereof.

24. The process of claim 21 wherein said polar solvent is selected from the group consisting of ($C_1$–$C_5$) alcohols, glycols, glycol monoethers, water and mixtures thereof.

25. The process of claim 21 wherein said metal base is selected from the group consisting of lithium hydroxide, $Ca(OH)_2$, $Ba(OH)_2$, NaOH, KOH, $Mg(OH)_2$, $Li_2O$, CaO, $Na_2O$, $K_2O$, MgO and alkoxides of ($C_1$–$C_5$) alcohols, glycols and glycol-mono-ethers.

26. The process of claim 21 wherein the metal salt contains a diluent oil consisting essentially of a mineral oil or synthetic oil having a kinematic viscosity of about 15 to about 40 cs at 40° C.

27. The process of claim 21 wherein the parts by weight ratio of hydrocarbon solvent to polar solvent ranges from about 0.1:1.0 to about 10.0:1.0.

28. The process of claim 21 wherein the parts by weight ratio of polar solvent to metal salt ranges from about 0.05:1.0 to about 1.0:1.0.

29. The process of claim 21 wherein the metal salt is overbased with about 1.0 to about 30.0 moles of metal base per mole of metal salt.

30. The process of claim 21 wherein the metal salt is borated with about 0.10 to about 5.0 moles of borating agent per mole of metal base.

31. The process of claim 21 wherein the acid gas is passed through said mixture in a quantity of about 0.5 to about 2.0 moles per mole of metal base mixed with the metal salt.

32. The process of claim 31 wherein the acid gas is $CO_2$ or $SO_2$.

33. The process of claim 21 wherein the borating agent is added to at a temperature ranging from about 20° to about 60° C.

34. The process of claim 33 wherein the borating agent is boric acid or boric oxide.

35. The process of claim 21 wherein the borated mixture is heated to a maximum temperature equal to the reflux temperature of solvent mixture for a period of about 0 to about 4.0 hours before the polar solvent and water are distilled therefrom.

36. The process of claim 21 wherein the distilled borated mixture is cooled to a temperature ranging from about 80° C. to about 20° C.

37. The process of claim 21 wherein the cooled distilled borated mixture is stripped under atmospheric pressure at a temperature ranging from about 80° to about 180° C.

38. The process of claim 32 wherein the $CO_2$ or $SO_2$ is passed through said mixture at a quantity of about 0.5 to about 1.0 mole per mole of metal base at a temperature ranging from about 20° to about 100° C. for a period of about 0.5 to about 5.0 hours.

39. The process of claim 22 wherein said hydrocarbon solvent is a ($C_6$–$C_8$) aliphatic hydrocarbon.

40. The process of claim 21 wherein said polar solvent is methanol.

41. The process of claim 1 wherein the metal salt is selected from the group of salts consisting of mineral oil sulfonates, ($C_{12}$–$C_{50}$) alkyl sulfonates, ($C_{12}$–$C_{50}$) aryl sulfonates, ($C_{12}$–$C_{50}$) alkenyl sulfonates, ($C_{12}$–$C_{50}$) alkylphenol sulfonates, ($C_{12}$–$C_{50}$) alkyl salicylates, ($C_{12}$–$C_{50}$) alkylphenates, sulfur-coupled ($C_{12}$–$C_{50}$) alkylphenates, amino bis-($C_1$–$C_{10}$) alkylene-coupled ($C_{12}$–$C_{50}$) alkylphenates, ($C_1$–$C_{10}$) alkylene-coupled, ($C_{12}$–$C_{50}$) alkylphenates, ($C_{12}$–$C_{50}$) alkenecarboxylates, ($C_{12}$–$C_{50}$) alkenylsuccinamates, ($C_{12}$–$C_{50}$) alkane or olefin oxidates and ($C_{12}$–$C_{50}$) alkylaryl carboxylates.

42. The process of claim 21 wherein the metal salt is selected from the group of salts, consisting of mineral oil sulfonates, ($C_{12}$–$C_{50}$) alkyl sulfonates, ($C_{12}$–$C_{50}$) aryl sulfonates, ($C_{12}$–$C_{50}$) alkenyl sulfonates, ($C_{12}$–$C_{50}$) alkylphenol sulfonates, ($C_{12}$–$C_{50}$) alkyl salicylates, ($C_{12}$–$C_{50}$) alkylphenates, sulfur-coupled ($C_{12}$–$C_{50}$) alkylphenates, amino bis-($C_1$–$C_{10}$) alkylene-coupled ($C_{12}$–$C_{50}$) alkylphenates, ($C_1$–$C_{10}$) alkylene-coupled, ($C_{12}$–$C_{50}$) alkylphenates, ($C_{12}$–$C_{20}$) alkanecarboxylates, ($C_{12}$–$C_{50}$) alkenylsuccinamates, ($C_{12}$–$C_{50}$) alkane or olefin oxidates and ($C_{12}$–$C_{50}$) alkylaryl carboxylates.

* * * * *